US007303429B2

(12) United States Patent
Kim

(10) Patent No.: US 7,303,429 B2
(45) Date of Patent: Dec. 4, 2007

(54) TERMINAL AND CONNECTOR USING THE SAME

(75) Inventor: Tae Hyoung Kim, Osan (KR)

(73) Assignee: Hitachi-LG Data Storage Korea, Inc., Seoul (KR)

( * ) Notice: Subject to any disclaimer, the term of this patent is extended or adjusted under 35 U.S.C. 154(b) by 0 days.

(21) Appl. No.: 11/476,661

(22) Filed: Jun. 29, 2006

(65) Prior Publication Data

US 2007/0010126 A1 Jan. 11, 2007

(30) Foreign Application Priority Data

Jun. 30, 2005 (KR) ..... 10-2005-0058307

(51) Int. Cl.
*H01R 12/24* (2006.01)

(52) U.S. Cl. ..... 439/495; 439/425

(58) Field of Classification Search ..... 439/495, 439/493, 425

See application file for complete search history.

(56) References Cited

U.S. PATENT DOCUMENTS 3,932,018 A * 1/1976 Parsons et al. ..... 439/422
4,352,537 A * 10/1982 Guelden ..... 439/425
4,865,561 A * 9/1989 Collier et al. ..... 439/391
5,417,581 A * 5/1995 Dechelette et al. ..... 439/393
5,474,468 A * 12/1995 Chishima et al. ..... 439/495
6,099,346 A * 8/2000 Hashiguchi et al. ..... 439/495
6,305,971 B1 * 10/2001 Yu-Feng ..... 439/493
6,394,838 B1 * 5/2002 Yen ..... 439/492
2006/0178039 A1 * 8/2006 Chen ..... 439/495

* cited by examiner

*Primary Examiner*—Neil Abrams
*Assistant Examiner*—Phuongchi Nguyen
(74) *Attorney, Agent, or Firm*—Birch, Stewart, Kolasch & Birch, LLP

(57) ABSTRACT

A terminal and a connector using the same are provided. The terminal includes a contact portion having a number of contact protrusions for making electrical contact with terminal portions of a cable; a support portion connected to the contact portion via a connection portion and supported on a fixing portion to prevent the contact portion from playing; and a mounting portion positioned on a side of the connection portion and electrically connected to an outside. The contact portion preferably has at least two contact protrusions. The terminal and connector using the same guarantee electrical connection between a flexible cable and a substrate. This improves the reliability in operation of a product using the connector.

9 Claims, 3 Drawing Sheets

TERMINAL AND CONNECTOR USING THE SAME

BACKGROUND OF THE INVENTION

1. Field of the Invention

The present invention relates to a terminal and a connector using the same. More particularly, the present invention relates to a terminal for electrically connecting components to each other and a connector using the same.

2. Description of the Prior Art

FIG. 1 shows a conventional connector, which is mounted on a substrate. Referring to FIG. 1, a connector 5 is used to electrically connect the substrate 1 to a flexible cable 3. A housing 6 defines the contour of the connector 5. The housing 6 is provided with an actuator 7, which prevents the flexible cable 3 from unintentionally escaping from the housing 6 once inserted therein.

The housing 6 is provided with terminals 10, which are generally made of a metallic conductor. A number of terminals 10 are arranged side by side so that a number of signals are transmitted simultaneously. The terminals 10 have a leading end positioned inside the housing 6 and a trailing end exposed to the outside via one side of the housing 6.

The construction of the terminals 10 will now be described briefly. The terminals 10 have elongated contact portions 11, which are electrically connected to terminal portions 3' of the flexible cable 3, respectively. The number of the terminal portions 3' of the flexible cable 3 is identical to that of the terminals 10. The contact portions 11 have contact protrusions 12 protruding from their leading end so as to be pressed against the terminal portions 3' of the flexible cable 3.

Support portions 13 extend in a direction parallel to the contact portions 11. Particularly, the support portions 13 extend in the same direction as the contact portions 11 at a predetermined distance from them. The support portions 13 prevent the terminals 10 from playing, e.g. penetrating into the housing 6, when the actuator 7 presses the flexible cable 3. To this end, the support portions 13 are supported on one side of the actuator 7 or the housing 6. The contact portions 11 and the support portions 13 are connected end-to-end via connection portions 14.

The connection portions 14 have a mounting portion 15 protruding from their end. The mounting portions 15 are soldered and electrically connected to the substrate 1. Particularly, the mounting portions 15 are electrically and mechanically connected to the substrate 1 by solder portions 16, which are created through the soldering process. The connection portions 14 and the mounting portions 15 are exposed to the outside of the housing 6.

In the case of the conventional connector 5, which is constructed as above, the actuator 7 is operated, while the flexible cable 3 is inserted into the housing 6, so that the contact protrusions 12 of the contact portions 11 are forced against the terminal portions 3' of the flexible cable 3, for electric connection.

However, the conventional connector has the following problems.

The surface of the terminal portions 3' of the flexible cable 3 may be covered with alien substances or oxidized. If the contact protrusions 12 make contact with the contaminated or oxidized surface, the terminal portions 3' may fail to be electrically connected to the terminals 10. This means that the connector 5 cannot electrically connect the substrate 1 to the flexible cable 3 in a reliable manner.

SUMMARY OF THE INVENTION

Accordingly, the present invention has been made to solve the above-mentioned problems occurring in the prior art, and an object of the present invention is to provide a connector for electrically connecting a substrate to a flexible cable by connecting a single terminal to a number of terminal portions of the flexible cable.

Another object of the present invention is to provide a connector for electrically connecting a substrate to a flexible cable regardless of oxide coating formed on terminal portions of the flexible cable.

In order to accomplish these objects, there is provided a terminal made of a conductive metal, including a contact portion having a number of contact protrusions for making electrical contact with terminal portions of a cable; a support portion connected to the contact portion via a connection portion and supported on a fixing portion to prevent the contact portion from playing; and a mounting portion positioned on a side of the connection portion and electrically connected to an outside.

In accordance with another aspect of the present invention, there is provided a terminal positioned on a connector mounted on a substrate, the terminal including a first side electrically connected to the substrate; a second side electrically connected to terminal portions of a flexible cable; a contact portion electrically connected to the terminal portions of the flexible cable; and at least two contact protrusions positioned on the contact portion and electrically connected to the terminal portions, respectively.

In accordance with another aspect of the present invention, there is provided a connector including a housing; a number of terminals positioned in the housing while being at least partially exposed to an outside and electrically connected to a substrate, the terminals having a thickness smaller than a width so that the terminals are arranged at a predetermined interval, at least two contact protrusions being formed on the terminals while being electrically connected to terminal portions of a cable; and an attachment means positioned on the housing so as to attach the terminal portions of the cable to the contact protrusions of the terminals.

The inventive terminal and connector using the same guarantee electrical connection between a flexible cable and a substrate. This improves the reliability in operation of a product using the connector.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
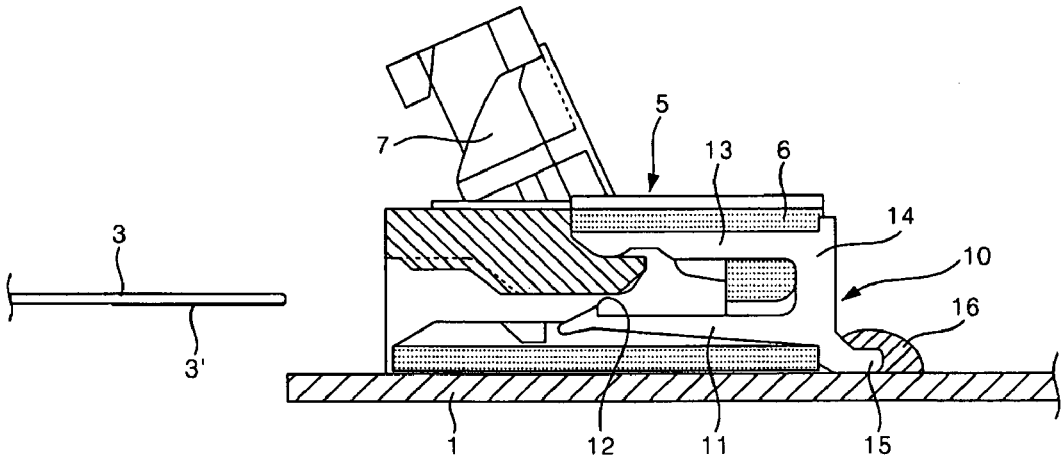
FIG. 1 Related Art
FIG. 1 is a sectional view showing a conventional connector, which is mounted on a substrate.
Figure 2:
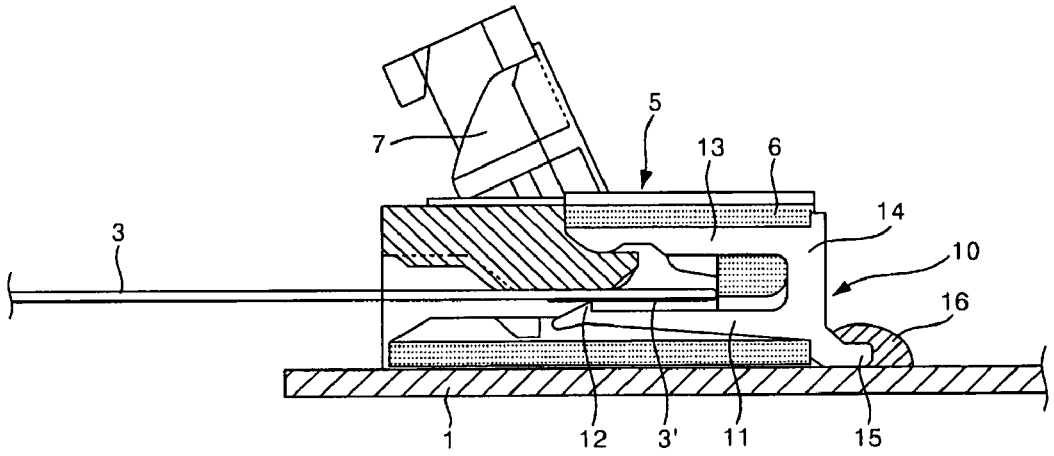
FIG. 2 Related Art
FIG. 2 is a sectional view showing a conventional connector, which is connected to a flexible cable.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 3:
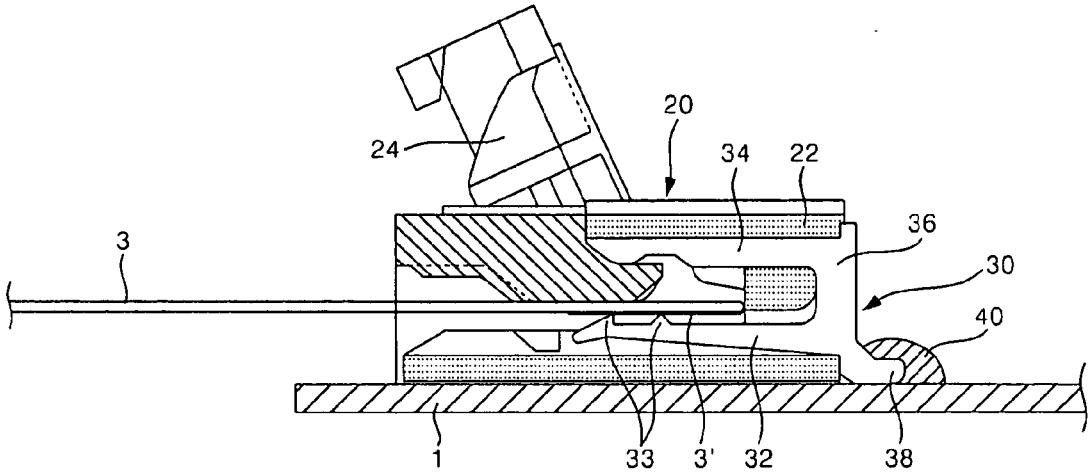
FIG. 3 is a sectional view showing a connector according to a preferred embodiment of the present invention.
Figure 4:
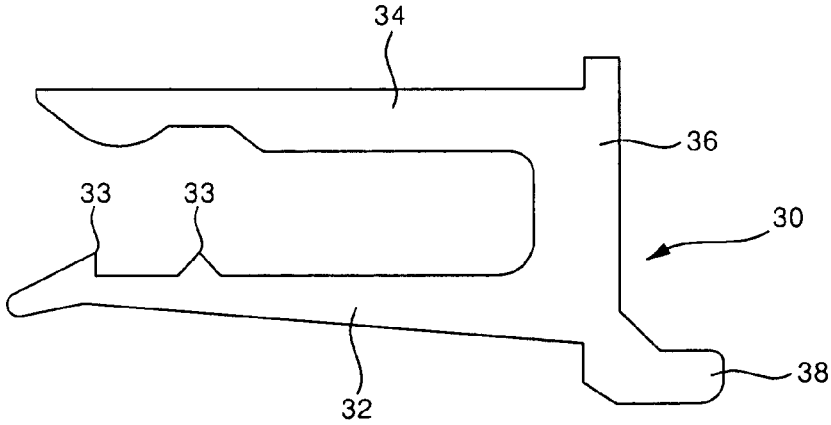
FIG. 4 is a sectional view showing the construction of a terminal according to a preferred embodiment of the present invention.

FIG. 3 is a sectional view showing a connector according to a preferred embodiment of the present invention, and FIG. 4 is a sectional view showing the construction of a terminal according to a preferred embodiment of the present invention.

Referring to the drawings, a housing 22 defines the framework and contour of a connector 20. The housing 22 is made of an insulative material. Generally, the housing 22 is fabricated by injection-molding a synthetic resin. The housing 22 has the shape of a hexahedron, which is flat and elongated in a direction. The housing 22 has an actuator 24 positioned on one side thereof. The actuator 24 is operated so as to retain the flexible cable 3 inside the housing 3 and guarantee electrical contact between the flexible cable 3 and the terminal 30 (described later). The actuator 24 may be interlocked with a single member or at least two members. In the present embodiment, a single member is rotatably positioned on the housing 22 and has a cam positioned on one side thereof so that, in accordance with rotation of the actuator 24, one side of the terminal 30 is pressed and retained, as shown in the drawings.

A number of terminals 30 are positioned in the housing 20 at a predetermined interval. The number of the terminals 30 is identical to that of terminal portions 3' formed on the flexible cable 3.

The construction of the terminal 30 will now be described in detail with reference to FIG. 4. The terminal 30 is made of a electrically conductive metallic material. The terminal 30 generally has a uniform thickness. The terminal 30 is fabricated by pressing a metal plate.

The terminal 30 has a contact portion 32 elongated in a direction. The contact portion 32 has a length determined so as to be contained inside the housing 22. The contact portion 32 has a number of contact protrusions 33 formed thereon. The contact protrusions 33 protrude from the contact portion 32. The contact portion 32 has a width approximately corresponding to that of the terminal portions 3' formed on the flexible cable 3. Referring to FIG. 4, the leading end of the contact protrusions 33 has a width smaller than that of the terminal portions 3'. Preferably, the longitudinal section of the contact protrusions 33 has a triangular shape. In the present embodiment, two contact protrusions 33 are formed at a predetermined distance from the leading end of the contact portion 32.

The terminal 30 has a support portion 34 extending in a direction parallel to the contact portion 32. The support portion 34 engages with one side of the housing 32 or the actuator 24 and prevents the terminal 30 from playing inside the housing 22, even when acted on by external force. The support portion 34 is designed so as to parallel the contact portion 32.

The contact and support portions 32 and 34 are connected to each other via a connection portion 36. Particularly, the connection portion 36 physically connects the contact and support portions 32 and 34 to each other so that the entire terminal 30 becomes a single unit.

The connection portion 36 has a mounting portion 38 formed on its end. The mounting portion 38 protrudes out of the housing 22 and is soldered to a substrate 1 for mounting. A solder portion 40 is created by mounting the mounting portion 38 on the substrate 1. The position of the mounting portion 38 depends on the direction in which the connector 20 is mounted on the substrate 1.

The thickness of the terminal 30, including the contact portion 32, the support portion 34, the connection portion 36, and the mounting portion 38, may be smaller than that shown in the drawings so that more terminals can be installed at an interval in a limited space. As a result, more signals can be transmitted simultaneously.

Figure 5A:
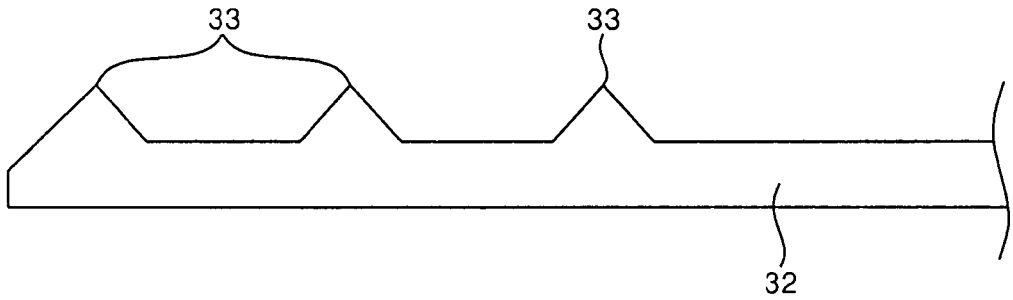
FIGS. 5*a* and 5*b* are lateral sectional views showing terminals according to alternative embodiments of the present invention.

Alternative terminals 30 will now be described with reference to FIGS. 5*a* and 5*b*. FIG. 5*a* shows a terminal 30 having three contact protrusions 33 formed thereon. If necessary, the terminal 30 may have more than three contact protrusions 33. The longitudinal lateral section of the contact protrusions 33 has a triangular shape.

Figure 5B:
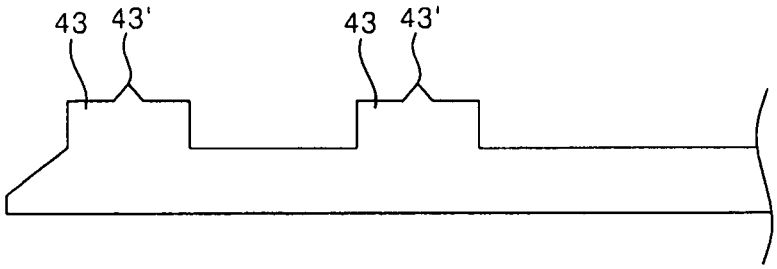

FIG. 5*b* shows a terminal 30 provided with contact protrusions 43, the longitudinal lateral section of which has a square shape. The contact protrusions 43 have a push nib 43' formed on their leading end. When forced against the terminal portions 3' of the flexible cable 3, the push nibs 43' penetrate into the terminal portions 3' to some degree. The push nibs 43' couple the flexible cable 3 to the terminal 30 in an electrically conductive manner. In addition, the contact between the contact protrusions 43 and the terminal portions 3' increases the area for electrical conductance.

Figure 6:
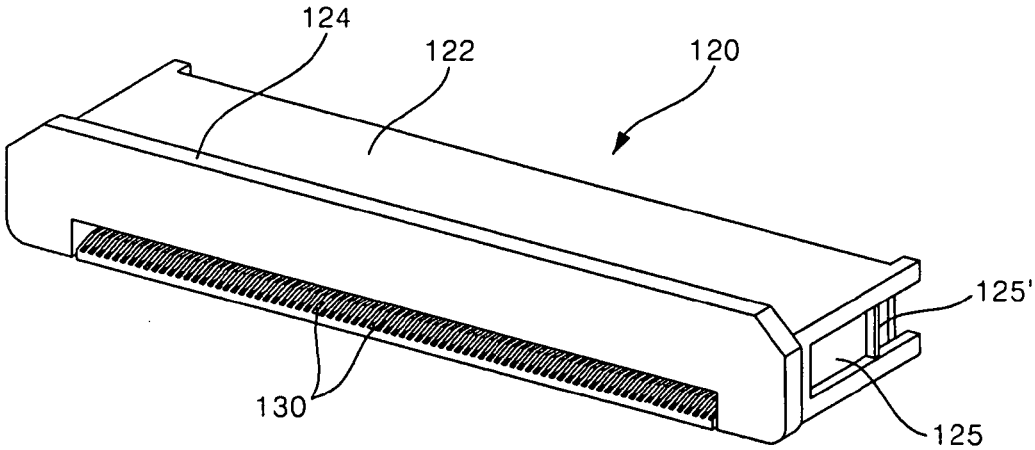
FIG. 6 is a perspective view showing a terminal according to the present invention, which is used for another type of connector.

FIG. 6 shows a terminal according to the present invention, which is used for another type of connector. A housing 122 defines the framework and contour of a connector 120. The housing 122 has a fastening slider 124 positioned on its leading end. The fastening slider 124 has latching legs 125 formed on both ends of its rear surface in such a manner that the latching legs 125 extend through both ends of the housings 122. The latching legs 125 have a latching step 125' formed on their leading end so that the fastening slider 124 does not escape from the housing 122 unintentionally. The fastening slider 124 protrudes a predetermined distance towards the front of the housing 122. Alternatively, the fastening slider 124 is adapted to be contained inside the housing 122.

The housing 122 has a terminal 130 positioned therein. The terminal 130 may have the same construction as shown in FIG. 4 or 5. The terminal 130 makes contact with the terminal portions 3' of the flexible cable 3 inserted into the housing 122. In this state, one side of the fastening slider 124 is inserted into the housing 122 so that the flexible cable 3 is fixed to the terminal 130 and makes contact with it.

The operation of the inventive terminal, which is constructed as mentioned above, as well as a connector using the same will now be described in detail.

The connector 20 is electrically connected to and mounted on the substrate 1 by soldering the mounting portion 38 of the terminal 30 to the substrate 1. The flexible cable 3 is inserted into the connector 20 mounted on the substrate 1. The actuator 24 has already been released. Particularly, the actuator 24 protrudes from the housing 22 so that all sides of the actuator 24 stay away from the contact portion 32.

After inserting the flexible cable 3 into the housing 22, the actuator 24 is operated so as to force the flexible cable 3 against the contact portion 32. Particularly, the contact protrusions 33, which are formed on the contact portion 32 of the terminal 30, are forced against the terminal portions 3' of the flexible cable 3. As a result, the contact protrusions 33 penetrate into the terminal portions 3' and make contact with them.

When one of the contact protrusions 33 is contaminated with alien substances or oxidized, that contact protrusion 33 cannot properly make electrical connection with the corresponding terminal portion 3'. Even so, other contact protrusions 33 make electrical contact with corresponding terminal portions 3' and guarantee electrical connection between the terminal 30 and the terminal portions 3'.

The pointed leading ends of the contact protrusions 33 penetrate into the terminal portions 3' through oxide coating, if any, and electrically connect the terminal portions 3' to the contact portions 32 of the terminal 30.

When more contact protrusions 33 are used, as shown in FIG. 5*a*, the contact properties between the terminal 30 and the terminal portions 3' improve. Alternatively, the longitudinal lateral section of the contact protrusions 43 may have a square shape, and the contact protrusions 43 may have push nibs 43 positioned on their leading end, as shown in FIG. 5*b*. In this case, the push nibs 43' penetrate into the terminal portions 3' and the leading ends of the contact protrusions 43, which have a larger area, make contact with the terminal portions 3'. This increases the area for electrical connection and guarantees stable connection. It can be easily understood by those skilled in the art that the shape of the longitudinal lateral section of the contact protrusions 43 is not limited to a square and may be a polygon, for example.

Referring to FIG. 6, the connector 120 uses a fastening slider 124, instead of an actuator, in order to lock the flexible cable 3 onto the terminal 130. The fastening slider 124 is composed of a single member, one side of which is adapted to linearly move into and out of the housing 122 in a simple manner.

As mentioned above, the inventive terminal and the connector using the same have the following advantages.

The contact portion of the terminal has a number of contact protrusions for making contact with corresponding terminal portions of the flexible cable. Therefore, even when some contact protrusions are contaminated with alien substances or oxidized, other contact protrusions are electrically connected to corresponding terminal portions.

This guarantees reliable electrical connection between the terminal of the connector and the terminal portions of the flexible cable and improves the reliability in operation of a product using the inventive connector.

The contact protrusions have pointed leading ends, which can penetrate into the terminal portions through oxide coating or alien substance, if any. This guarantees sufficient electrical connection between the terminal portions and the contact portions and improves the reliability in operation of a product using the inventive connector.

Although a preferred embodiment of the present invention has been described for illustrative purposes, those skilled in the art will appreciate that various modifications, additions and substitutions are possible, without departing from the scope and spirit of the invention as disclosed in the accompanying claims.

For example, the terminals 30 and 130 according to the embodiments of the present invention are applicable to not only the connectors 20 and 120 disclosed herein, but also other types of connectors.

What is claimed is:

1. A terminal made of a conductive metal, comprising:

a contact portion having a number of contact protrusions for making electrical contact with terminal portions of a cable, a longitudinal lateral section of each contact protrusion having a polygonal shape, a push nib being positioned on a leading end of each contact protrusion, the push nib having a pointed leading end;

a support portion connected to the contact portion via a connection portion and supported on a fixing portion to prevent the contact portion from playing; and a mounting portion positioned on a side of the connection portion and electrically connected to an outside.

2. The terminal as claimed in claim 1, wherein the push nib has a triangular shape.

3. The terminal as claimed in claim 1, wherein the contact portion, the support portion, and the mounting portion have a width larger than a thickness.

4. A terminal positioned on a connector mounted on a substrate, the terminal comprising:

a first side electrically connected to the substrate;

a second side electrically connected to terminal portions of a flexible cable;

a contact portion electrically connected to the terminal portions of the flexible cable; and at least two contact protrusions positioned on the contact portion and electrically connected to the terminal portions, respectively, a longitudinal lateral section of each contact protrusion having a polygonal shape, a push nib being positioned on a leading end of each contact protrusion, the push nib having a pointed leading end.

5. The terminal as claimed in claim 4, wherein the push nib has a triangular shape.

6. The terminal as claimed in claim 4, wherein the contact portion, a support portion, and a mounting portion have a width larger than a thickness.

7. A connector comprising:

a housing;

a number of terminals positioned in the housing while being at least partially exposed to an outside and electrically connected to a substrate, the terminals are arranged at a predetermined interval, at least two contact protrusions being formed on each of the terminals while being electrically connected to terminal portions of a cable, a longitudinal lateral section of each contact protrusion having a polygonal shape, a push nib being positioned on a leading end of each contact protrusion, the push nib having a pointed leading end; and an attachment device positioned on the housing so as to attach the terminal portions of the cable to the contact protrusions of the terminals.

8. The connector as claimed in claim 7, wherein each of the terminals comprises:

a contact portion having the at least two contact protrusions;

a support portion extending in a direction parallel to the contact portion, the support portion having an end connected to the contact portion via a connection portion, the support portion being supported on a fixing portion to prevent the contact portion from playing; and a mounting portion positioned on a side of the connection portion and electrically connected to an outside.

9. The connector as claimed in claim 7, wherein the push nib has a triangular shape.

* * * * *